US008061871B2

(12) United States Patent
Brandl et al.

(10) Patent No.: US 8,061,871 B2
(45) Date of Patent: Nov. 22, 2011

(54) LAMP RING, LAMP AND BASE MOUNTING MACHINE

(75) Inventors: Franz Brandl, Ochsenfeld (DE); Jürgen Hallmeier, Adelschlag (DE); Klaus Knorr, Nennslingen (DE)

(73) Assignee: OSRAM AG, Munich (DE)

( * ) Notice: Subject to any disclaimer, the term of this patent is extended or adjusted under 35 U.S.C. 154(b) by 548 days.

(21) Appl. No.: 11/922,355

(22) PCT Filed: Jun. 14, 2006

(86) PCT No.: PCT/DE2006/001026

§ 371 (c)(1),
(2), (4) Date: Dec. 17, 2007

(87) PCT Pub. No.: WO2006/133687

PCT Pub. Date: Dec. 21, 2006

(65) Prior Publication Data

US 2009/0116253 A1 May 7, 2009

(30) Foreign Application Priority Data

Jun. 17, 2005 (DE) ..... 10 2005 028 506

(51) Int. Cl.
*F21V 17/06* (2006.01)

(52) U.S. Cl. ..... 362/255; 362/549; 313/318.01; 445/66

(58) Field of Classification Search ..... 362/459, 362/519, 548, 549, 285, 255; 313/318.01, 313/493, 634; 445/66, 67, 69
See application file for complete search history.

(56) References Cited

U.S. PATENT DOCUMENTS

| | | | | |
|---|---|---|---|---|
| 2,924,190 | A * | 2/1960 | Greiner et al. | 445/66 |
| 4,470,104 | A | 9/1984 | Cox | |
| 4,890,202 | A * | 12/1989 | Blanche | 362/519 |
| 4,950,942 | A * | 8/1990 | Braun et al. | 313/318.07 |
| 5,010,272 | A * | 4/1991 | Eckhardt et al. | 313/579 |
| 5,072,348 | A * | 12/1991 | Tsukada | 362/549 |
| 5,115,381 | A * | 5/1992 | Van Heeswijk | 362/519 |
| 5,220,235 | A * | 6/1993 | Wakimizu et al. | 313/25 |
| 5,313,135 | A * | 5/1994 | Fletcher | 313/318.01 |
| 6,528,931 | B1 * | 3/2003 | Umehara et al. | 313/318.01 |
| 6,929,837 | B2 * | 8/2005 | Morrison | 428/40.1 |

FOREIGN PATENT DOCUMENTS

| | | |
|---|---|---|
| DE | 120 535 | 1/1901 |
| DE | 35 21 962 | 1/1987 |
| WO | WO 2005/043036 | 5/2005 |

* cited by examiner

*Primary Examiner* — Jong-Suk (James) Lee
*Assistant Examiner* — Peggy A. Neils

(57) ABSTRACT

The invention relates to a lamp ring for a lamp, in particular an indicator lamp, which comprises a recess for coding and an additional recess for positioning the lamp ring in a base mounting machine. According to the invention, the second recess has an inner wall with a projection. The invention also relates to a lamp comprising a lamp ring of this type and to a base mounting machine for assembling a lamp of this type.

6 Claims, 6 Drawing Sheets

LAMP RING, LAMP AND BASE MOUNTING MACHINE

TECHNICAL FIELD

The invention relates to a lamp ring, a lamp provided with such a lamp ring and a base mounting machine with such a receptacle for producing such a lamp.

PRIOR ART

FIGS. 1 and 2 show, by way of example, a known indicator lamp 2 for light indicator systems. This indicator lamp 2 is a low-volt halogen incandescent lamp with a glass bulb 4, which is inserted into a shell 6. A filament 8 is arranged in the glass bulb 4, the power supply lines of said filament being connected to electrical terminals of a lampholder accommodating the indicator lamp 2 via the shell 6 and an electrical contact element 10. The shell 6 is surrounded by a lamp ring 12, which, as shown in FIG. 2, has a recess 14 for coding the indicator lamp 2.

Generally, the lamp ring is soldered to the shell 6 using lead solder in a manual production process. The use of lead solder is forbidden from now on, however, so that the lamp ring 12 should be, for example, laser-welded to the shell 6. In general, laser-welding takes place on an automated base mounting machine.

Since the above-described indicator lamp has a similar design to H3 lamps for motor vehicle headlamps, in particular for lower beam, upper beam and foglights, base mounting machines for H3 lamps are suitable for fitting and adjusting the indicator lamp in automated fashion. However, as shown in FIG. 3 an H3 lamp ring 16 has, in addition to a rectangular recess 18 on the circumferential side, which corresponds to the first recess 14 of the lamp ring for the indicator lamp 2, a diametrical arc recess 20 for coding purposes, special accommodating elements 22, 24 of the base mounting machine engaging in the rectangular recess 18 and the arc recess 20 in order to position the lamp ring 16 when it is welded to a shell.

One disadvantage is the fact that, owing to the special accommodating elements of the base mounting machine, the latter needs to be converted for fitting of the indicator lamp, which lasts for approximately 1.5 shifts and results in considerable conversion costs.

DESCRIPTION OF THE INVENTION

The invention is based on the object of providing a lamp ring, a lamp provided with such a lamp ring and a base mounting machine for producing such a lamp, the lamp ring and the base mounting machine being designed such that the lamp according to the invention and known H3 lamps can be manufactured on one base mounting machine without the latter needing to be converted.

The lamp ring according to the invention for a lamp, in particular for a low-volt halogen indicator lamp, has a cutout for inserting a shell and fixing lugs for fixing the lamp ring to the shell. Furthermore, the lamp ring has a first recess on the circumferential side for coding the lamp. According to the invention, the lamp ring has a diametrical second recess for positioning the lamp ring in a base mounting machine, the second recess having at least one projection on its inner wall.

A lamp according to the invention has a lamp ring for engaging around a shell. The lamp ring is fixedly connected to the shell and has two diametrical recesses on the circumferential side, of which recesses one has at least one projection on its inner wall.

A base mounting machine according to the invention for producing a lamp with a lamp ring with two diametrical recesses on the circumferential side, of which one inner wall has at least one projection, has a first and a second accommodating element for engaging in the recesses, the second accommodating element having a profiled top region, which is matched to the inner wall of the recess with at least one projection.

This solution has the advantage that the lamp ring according to the invention can be welded to a shell on the same base mounting machine as a known H3 lamp without the base mounting machine needing to be converted. In addition, as a result of the at least one projection on the inner wall of the second recess, a particular geometry is achieved which prevents a lamp with the lamp ring according to the invention being inserted into a lampholder for an H3 lamp, so that the noninterchangeability of the individual lamp types is still guaranteed. At the same time, however, the insertion of the lamp according to the invention in a lampholder associated with it is not made more difficult.

In a preferred exemplary embodiment of the lamp ring, the projection is set back via a side face of the inner wall from an outer circumferential section of the lamp ring.

Preferably, a second projection is provided which is arranged opposite the first projection, the projections being spaced apart from one another via a bottom face.

The projections can have an identical design, visible faces of the projections lying in one plane and opposite opposing faces running parallel.

The side faces and the bottom face can lie on an imaginary arc with a constant radius, which corresponds to the radius of an arc recess for coding an H3 lamp ring.

BRIEF DESCRIPTION OF THE DRAWINGS

The invention will be explained in more detail below with reference to a preferred exemplary embodiment. In the drawings.

PREFERRED EMBODIMENT OF THE INVENTION

Figure 4:
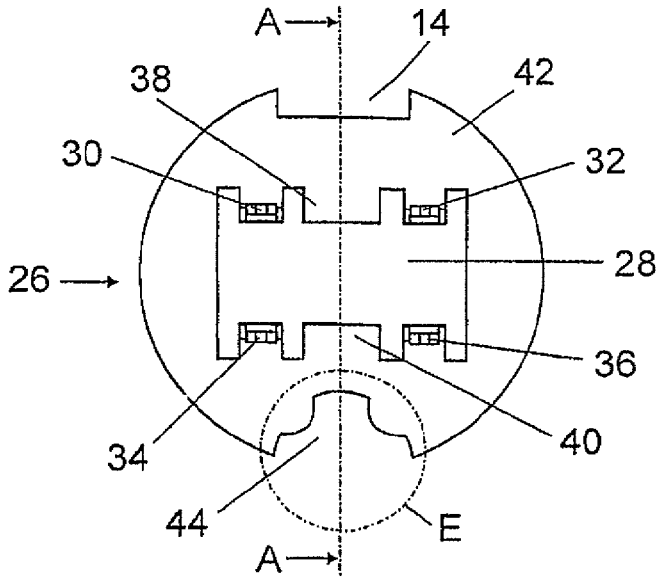
FIG. 4 shows a plan view of a lamp ring according to the invention.

FIG. 4 shows a plan view of a lamp ring 28 according to the invention for a lamp, in particular for a low-volt halogen indicator lamp for use in light indicator systems.

The lamp ring 26 has a mirror-symmetrical geometry with a circular cross section with a substantially rectangular, centered cutout 28 for accommodating a shell (not illustrated), into which a glass bulb with a filament can be inserted. In each case four fixing lugs 30, 32, 34, 36 for welding, in particular laser-welding, the lamp ring 26 to the shell are arranged on longitudinal sides of the cutout 28 and lie opposite one another in pairs. In each case one plate-like temporary securing element 38, 40 is formed between the adjacent fixing lugs 30, 32 and 34, 36 and prevents mounting clips of the lampholder unintentionally being pressed between the adjacent fixing lugs 30, 32 and 34, 36 when the lamp is inserted into a lampholder.

Figure 5:
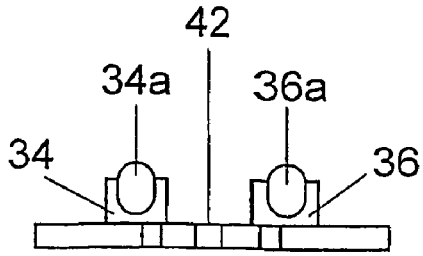
FIG. 5 shows an enlarged side view of the lamp ring shown in FIG. 4.
Figure 6:
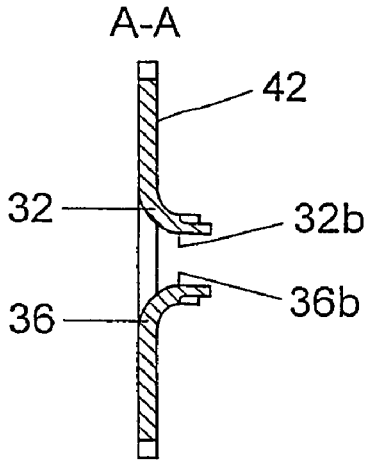
FIG. 6 shows a section through the lamp ring shown in FIG. 4 along the line A-A.

As shown in FIG. 5, the fixing lugs 30, 32, 34, 36 each have a top section, which is set at an angle of approximately 90° with respect to a surface 42 of the lamp ring 26. In order to achieve through-welding of the fixing lugs and therefore a high welding quality, the fixing lugs 30, 32, 34, 36 each have an embossed region 34*a*, 36*a* with a reduced wall thickness. The embossed regions 34*a*, 36*a* have an oval shape, which can, however, be freely selected depending on the geometry of an embossing die. Owing to the reduced wall thickness, the top sections have an enlarged area on the front side. In this case, the embossed regions 32*a*, 36*a* are introduced into the top sections as shown in FIG. 6 in such a way that planar welding faces 32*b*, 36*b* are formed, which can be arranged flat with opposite contact faces of the shell.

As shown in FIG. 4, the lamp ring 26 furthermore has a known rectangular first recess 14 for coding the lamp and a second recess 44 according to the invention, which is designed to be diametrical with respect to the first recess 14. The second recess 44 serves the purpose of accommodating an accommodating element 46 according to the invention of a base mounting machine (cf. FIG. 8).

Figure 7:
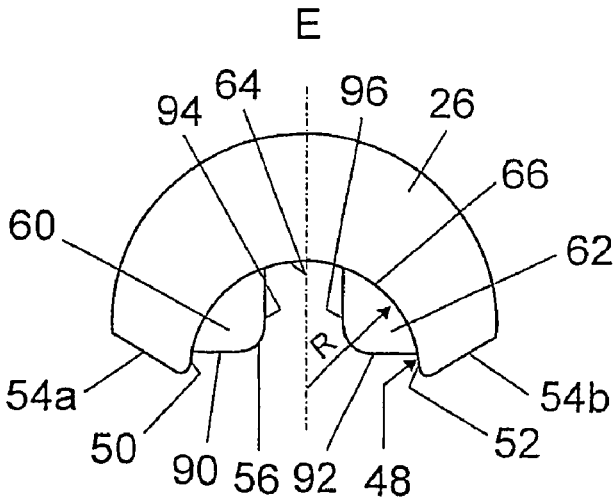
FIG. 7 shows an enlarged illustration of the second recess shown in FIG. 4.

As illustrated in FIG. 7, the second recess 44 has an inner wall 48, on which two opposite identical projections 60, 62 are formed. However, only one projection 60, 62 or a large number of projections 60, 62 can be provided. The projections 60, 62 are spaced apart from one another via a bottom face 64 and set back from outer circumferential sections 54*a*, 54*b* of the lamp ring 26 via side faces 50, 52. The projections 60, 62 each have an edge region 54, 56, which is formed from two visible faces 90, 92 lying in one plane and two opposing faces 94, 96 running parallel to one another. The bottom face 64 and the side faces 50, 52 are concave, whereby they lie on an imaginary arc 66 with a constant radius R, which corresponds to the radius of an arc recess 20 of an H3 lamp ring 16 (cf. FIGS. 3 and 10).

Figure 8:
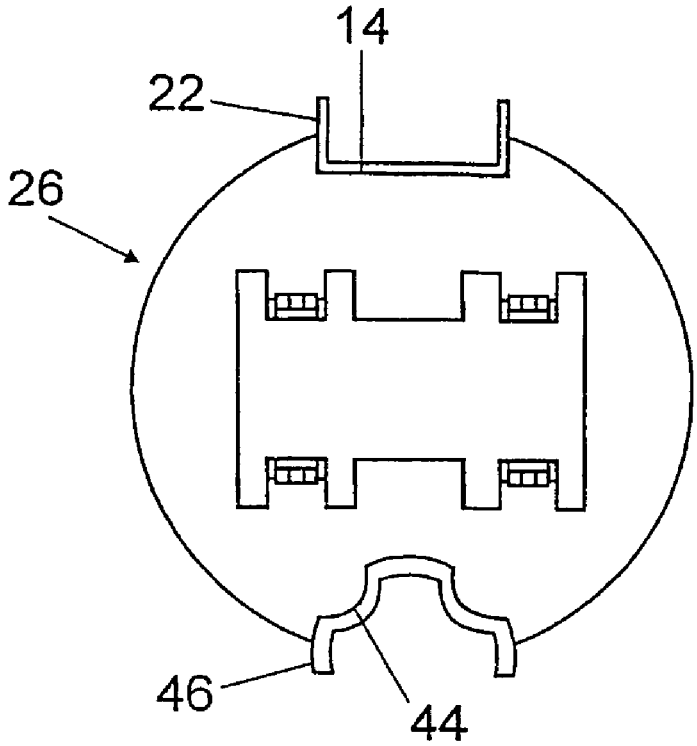
FIG. 8 shows a schematic arrangement of the lamp ring shown in FIG. 4 between two accommodating elements of the base mounting machine according to the invention.

As shown in FIG. 8, in the case of the arrangement of the lamp ring 26 in a base mounting machine according to the invention, in each case one top region of a first accommodating element 22 and of a second accommodating element 46 for fixing the lamp ring 26 when it is adjusted and welded to a shell engages in the first recess 14 and the second recess 44, respectively. The top region of the first accommodating element 22 has a known rectangular cross section corresponding to the first recess 14. The top region of the second accommodating element 46 has a cross section which substantially corresponds to the step-shaped cross section of the second recess 44.

Figure 9:
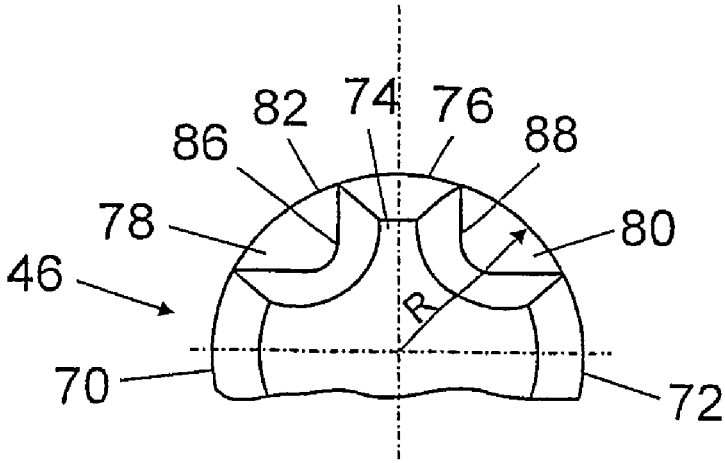
FIG. 9 shows a top region of an accommodating element of a base mounting machine according to the invention.

An enlarged illustration of the top region of the second accommodating element 46 according to the invention is shown in FIG. 9. The top region 70 is mirror-symmetrical and has two depressions 78, 80 in two opposite outer faces 70, 72, so that a finger-like body section 74 is formed on the front side for dipping in between the projections 60, 62 of the second recess 44. The outer faces 70, 72 are designed to be convex so as to correspond to the flat arrangement on the side faces 50, 52 of the lamp ring 26. Likewise, the depressions 78, 80 are designed so as to be complementary to the projections 60, 62 of the second recess 44. The body section 74 has a front face 76, which can be designed to be convex so as to correspond to the flat arrangement on the bottom face 64. The faces 70, 72, 76 and in each case one depression face 86, 88, which connects the front face 76 to the outer faces 70, 72, of the depression 78, 80 can be beveled so as to make it easy to introduce the accommodating element 46 into the recess 44. The front face 76 and the outer faces 70, 72 are arranged on an imaginary arc 82 with a constant radius R, which is selected such that the front face 76 and the outer faces 70, 72 can be brought into a flat arrangement with an inner circumferential wall 84 of an arc recess 20 of an H3 lamp ring 16 (cf. FIG. 10).

In order to fit the lamp, the lamp ring 26 is clamped in at right angles, i.e. with horizontally aligned top sections of the fixing lugs 30, 32, 34, 36, between the two accommodating elements 22, 46 of the base mounting machine which engage in an interlocking manner into the recesses 14, 44. The base mounting machine preferably has a large number of such accommodating elements 52, 54 on a rotating plate, so that a large number of lamp rings 26 can be fitted simultaneously. In a next fitting step, the shell is inserted into the cutout 28. In this case, the shell has already been prefitted, i.e. the glass bulb with the filament is connected to the shell and power supply lines of the indicator lamp 2 emerge at its free end. Then, a ground contact with the shell is produced via one power supply line. The filament is adjusted with respect to the surface 42 of the lamp ring 26 and then the shell is welded to the fixing lugs 30, 32, 34, 36 of the lamp ring 26 using a laser. Once the welding has taken place, the lamp ring 26 with the shell is removed from the base mounting machine and the second power supply line of the indicator lamp 2 is connected manually to an external electrical contact element, such as a cable, for example. The manual welding of the cable for the indicator lamp 2 is due to the base mounting machine, since the relatively long cables for the indicator lamp 2 are at present not provided.

Figure 10:
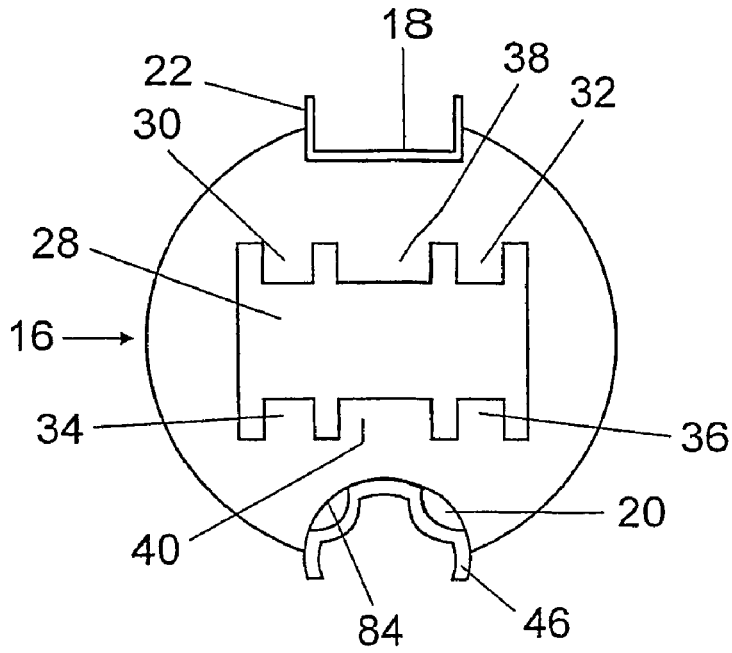
FIG. 10 shows an arrangement of a known lamp ring of an H3 lamp in the base mounting machine according to the invention.

As shown in FIG. 10, it is likewise possible to carry out fitting of an H3 lamp on the base mounting machine according to the invention. As has already been described at the outset with reference to FIG. 3, an H3 lamp ring 16 has substantially the same mirror-symmetrical geometry as the lamp ring 26 according to the invention with a circular cross section, a central cutout 28, fixing lugs 30, 32, 34, 36 and two plate-like temporary securing elements 38, 40. Furthermore, the H3 lamp ring 16 has a rectangular recess 18 on the circumferential side which corresponds to the first recess 14 of the lamp ring 26 according to the invention for coding the H3 lamp. In addition to the rectangular recess 18, the H3 lamp ring 16 has, for coding purposes, a diametrically arranged arc recess 20 with an arcuate inner circumferential wall 84.

The fitting of the H3 lamp takes place substantially in the same way as in the case of the lamp according to the invention. The only difference consists in the fact that preferably the connection of the second power supply line of the filament to an external electrical contact element does not take place manually outside the base mounting machine but in automated fashion in the base mounting machine. During fitting, in order to position the H3 lamp ring 16, the first accommodating element 22 engages in the rectangular recess 18 and the second accommodating element 46 engages in the arc recess 20, the convex outer faces 70, 72 and the convex front face 76 bearing flat against the inner circumferential wall 84 as a result of the geometry according to the invention of the top region of the second accommodating element 46, so that both the lamps according to the invention and known H3 lamps can be manufactured on the base mounting machine without any need to convert it.

Figure 11:
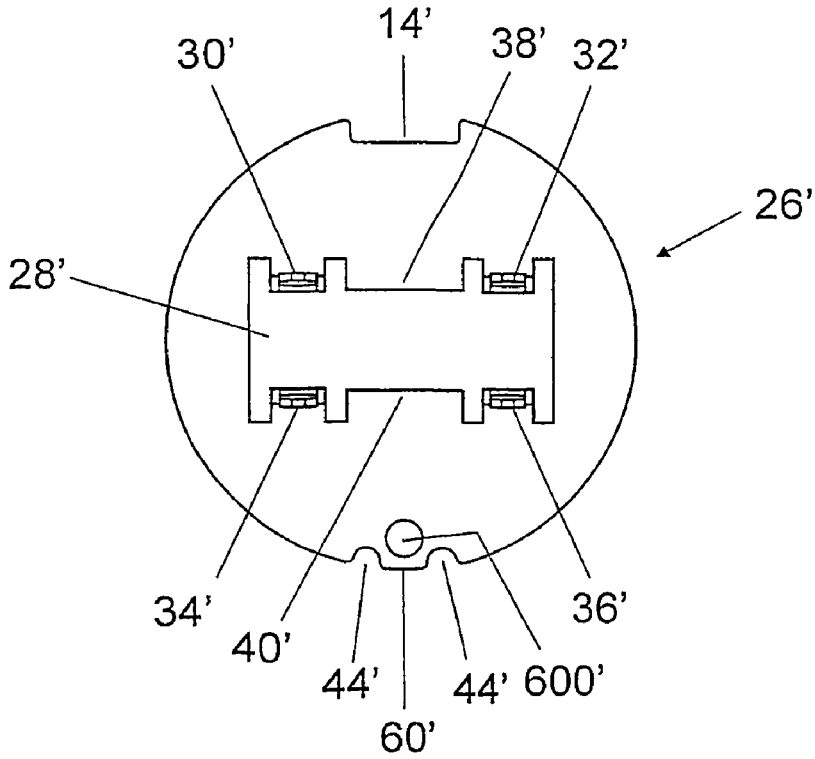
FIG. 11 shows a plan view of a lamp ring in accordance with the second exemplary embodiment of the invention.

FIG. 11 shows a plan view of a lamp ring 26' for a lamp, in particular for a low-volt halogen indicator lamp for use in light indicator systems, in accordance with the second exemplary embodiment of the invention.

The lamp ring 26' has a mirror-symmetrical geometry with a circular cross section with a substantially rectangular centered cutout 28' for accommodating a shell (not illustrated), into which a glass bulb with a filament can be inserted. In each case four fixing lugs 30', 32', 34', 36' for welding, in particular laser-welding, the lamp ring 26' to the shell are arranged on longitudinal sides of the cutout 28' and lie opposite one another in pairs. In each case one plate-like temporary securing element 38', 40' is formed between the adjacent fixing lugs 30', 32' and 34', 36' and prevents mounting clips of the lampholder unintentionally being pressed between the adjacent fixing lugs 30', 32' and 34', 36' when the lamp is inserted into a lampholder.

The fixing lugs 30', 32' and 34', 36' of the lamp ring 26' in accordance with the second exemplary embodiment of the invention have the same design and arrangement as the fixing lugs 30, 32 and 34, 36 of the lamp ring 26 in accordance with the first exemplary embodiment depicted in FIGS. 4 and 5.

As illustrated in FIG. 11, the lamp ring 26' in accordance with the second exemplary embodiment of the invention furthermore has a known, rectangular first recess 14' for coding the lamp and a second recess 44' according to the invention, which is arranged diametrically with respect to the first recess 14'. The second recess 44' serves the purpose of accommodating an accommodating element 46' in accordance with the second exemplary embodiment of the base mounting machine (cf. FIG. 12). The second recess 44' has an inner wall or edge, on which a central projection 60' is arranged. The central projection 60' splits the recess 44' into two identical halves, which are arranged symmetrically with respect to the two sides of the central projection 60'. The outer edge of the central projection 60' is formed by an arcuate arc, which lies on the circumference of the lamp ring 26'. An aperture 600' in the form of a circular disk is arranged in the lamp ring 26' in the region of the central projection 60'.

Figure 12:
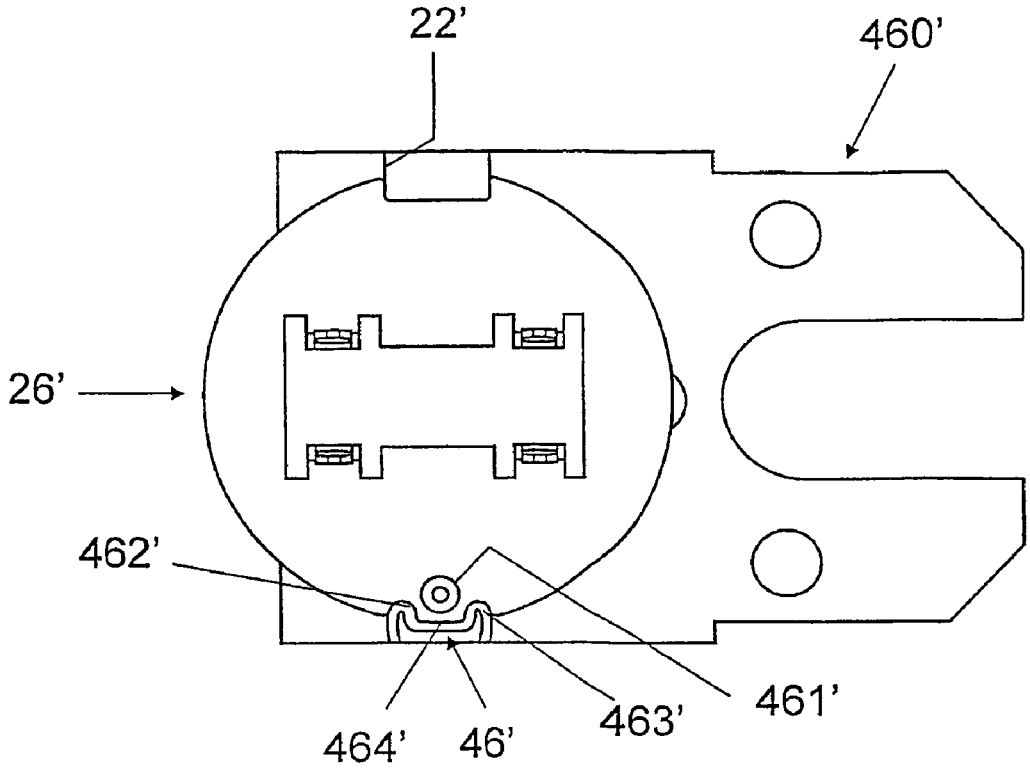
FIG. 12 shows an arrangement of the lamp ring shown in FIG. 10 in a base mounting machine in accordance with the second exemplary embodiment of the invention.

As illustrated in FIG. 12, when the lamp ring 26' according to the invention is arranged in a base mounting machine 460' in accordance with the second exemplary embodiment of the invention, the top region of a first accommodating element 22' engages in the first, rectangular recess 14', and the top region of a second accommodating element 46' of the base mounting machine engages in the second recess 44'. The second accommodating element 46' is matched so as to fit the second recess 44'. In particular, the second accommodating element 46' has a pin 461', which engages in the aperture 600' in the form of a circular disk, and two mirror-symmetrical sections 462', 463', which engage in the halves of the recess 44' which are arranged on both sides of the projection 60'. The sections 462', 463' of the second accommodating element 46' are connected to one another via a central section 464', which bears against the outer edge of the central projection 60'.

Figure 1:
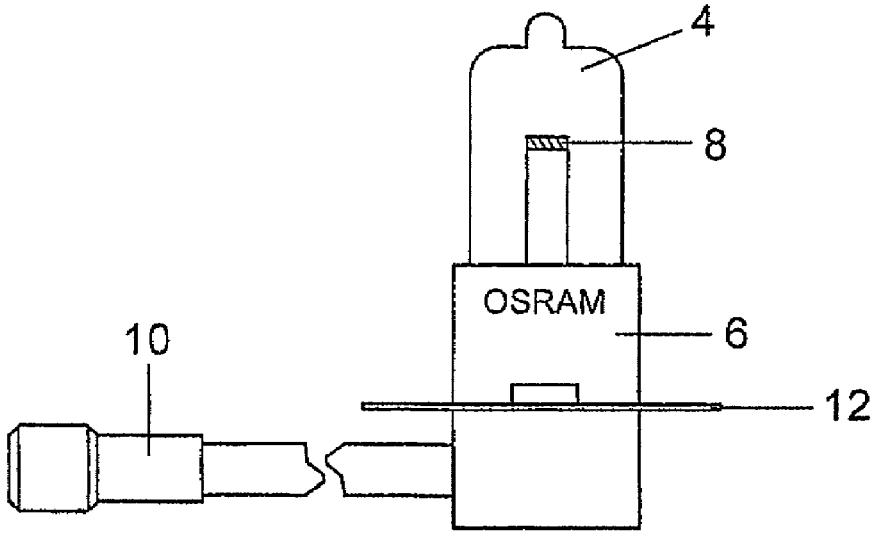
FIG 1 (PRIOR ART)
FIG. 1 shows a side view of a known indicator lamp.
Figure 2:
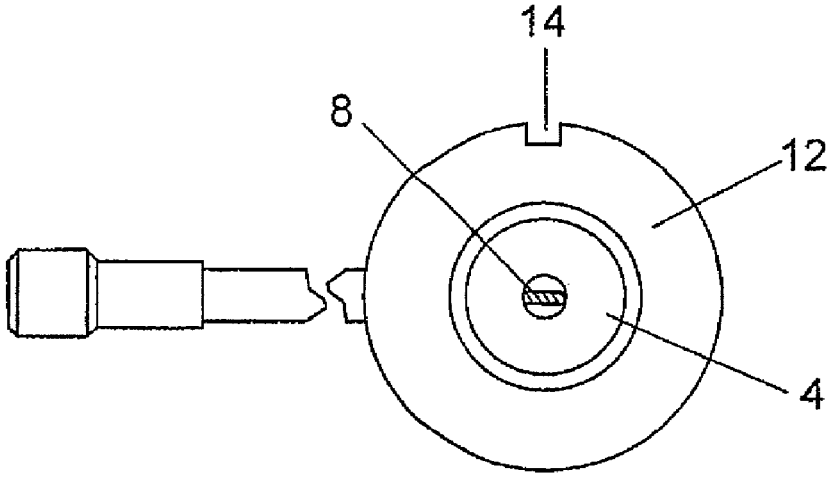
FIG 2 (PRIOR ART)
FIG. 2 shows a plan view of the indicator lamp shown in FIG. 1.
Figure 3:
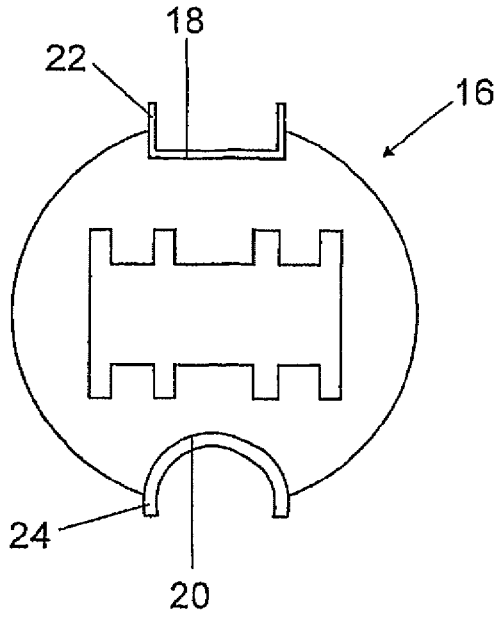
FIG 3 (PRIOR ART)
FIG. 3 shows an arrangement of a known lamp ring of an H3 lamp in a known base mounting machine.
Figure 13:
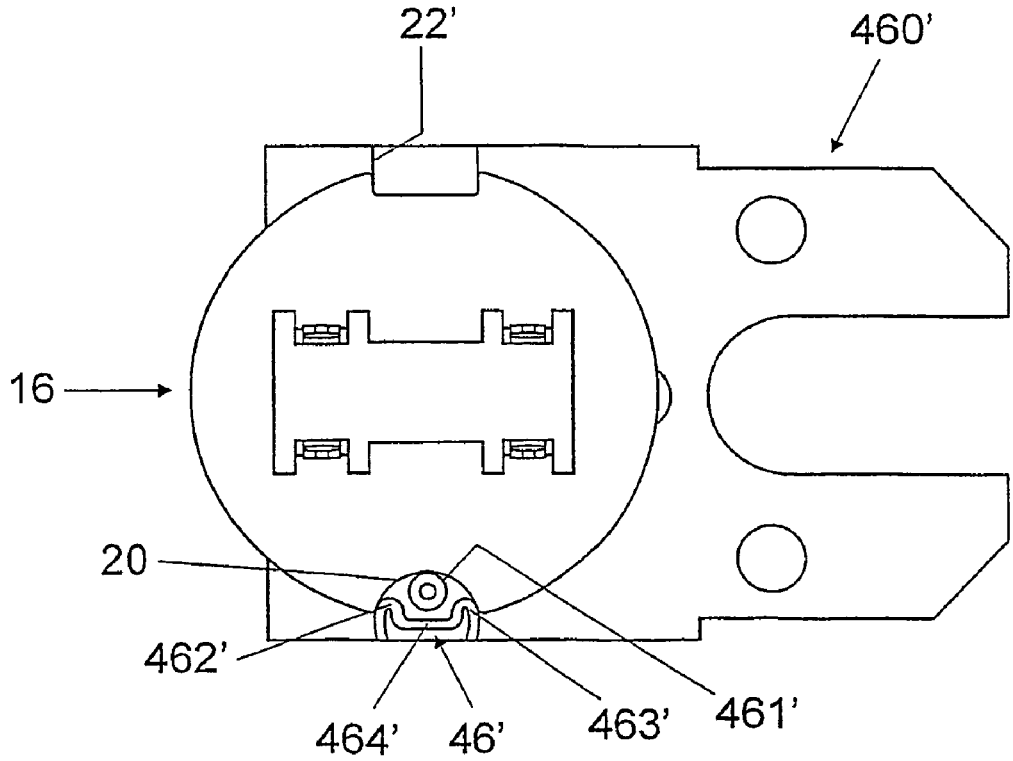
FIG. 13 shows an arrangement of a known lamp ring of an H3 lamp in the base mounting machine in accordance with the second exemplary embodiment of the invention.

The base mounting machine 460' in accordance with the second exemplary embodiment is also suitable for processing known H3 lamp rings 16 depicted in FIG. 3. As is illustrated in FIG. 13, in this case the second accommodating element 46' engages in the arcuate arc recess 20 of the H3 lamp ring 16. In this case, the pin 463' and the outer faces of the sections 462', 463' of the second accommodating element 46' bear against the outer edge of the lamp ring 16 in the region of the arc recess 20.

The invention diskloses a lamp ring for a lamp, in particular an indicator lamp, which has a recess for coding purposes and a further recess for positioning the lamp ring in a base mounting machine, the second recess having an inner wall with a projection, and a lamp with such a lamp ring and a base mounting machine for fitting such a lamp.

The invention claimed is:

1. A base mounting machine for producing a lamp, in particular for producing a low-volt halogen indicator lamp, with a lamp ring having a cutout for inserting a shell, and with fixing lugs for fixing the lamp ring to the shell, the lamp ring having a first recess on the circumferential side for coding the lamp, and a second recess, diametrically opposed to the first recess, for positioning the lamp ring in the base mounting machine, the second recess having an inner wall with at least one projection, the base mounting machine comprising a first and a second accommodating element for engaging in the first and the second recess of the lamp ring, the second accommodating element having a profiled top region, which is matched to the second recess.

2. A base mounting machine for producing a lamp, in particular for producing a low-volt halogen indicator lamp, with a lamp ring having a cutout for inserting a shell, and with fixing lugs for fixing the lamp ring to the shell, the lamp ring having a first recess on the circumferential side for coding the lamp, and a second recess, diametrically opposed to the first recess, for positioning the lamp ring in the base mounting machine, the second recess having an inner wall with at least one projection, the projection being set back via a side face of the inner wall from an outer circumferential section of the lamp ring, the base mounting machine comprising a first and a second accommodating element for engaging in the first and the second recess of the lamp ring, the second accommodating element having a profiled top region, which is matched to the second recess.

3. A base mounting machine for producing a lamp, in particular for producing a low-volt halogen indicator lamp, with a lamp ring having a cutout for inserting a shell, and with fixing lugs for fixing the lamp ring to the shell, the lamp ring having a first recess on the circumferential side for coding the lamp, and a second recess, diametrically opposed to the first recess, for positioning the lamp ring in the base mounting machine, the second recess having an inner wall with at least one projection, the projection being set back via a side face of the inner wall from an outer circumferential section of the lamp ring, the lamp ring further having a second projection, the base mounting machine comprising a first and a second accommodating element for engaging in the first and the second recess of the lamp ring, the second accommodating element having a profiled top region, which is matched to the second recess.

4. A base mounting machine for producing a lamp, in particular for producing a low-volt halogen indicator lamp, with a lamp ring having a cutout for inserting a shell, and with fixing lugs for fixing the lamp ring to the shell, the lamp ring having a first recess on the circumferential side for coding the lamp, and a second recess, diametrically opposed to the first recess, for positioning the lamp ring in the base mounting machine, the second recess having an inner wall with at least one projection, the projection being set back via a side face of the inner wall from an outer circumferential section of the lamp ring, the lamp ring further having a second projection, the projections being arranged opposite one another and being spaced apart from one another via a bottom face, the base mounting machine comprising a first and a second accommodating element for engaging in the first and the second recess of the lamp ring, the second accommodating element having a profiled top region, which is matched to the second recess.

5. A base mounting machine for producing a lamp, in particular for producing a low-volt halogen indicator lamp, with a lamp ring having a cutout for inserting a shell, and with fixing lugs for fixing the lamp ring to the shell, the lamp ring having a first recess on the circumferential side for coding the lamp, and a second recess, diametrically opposed to the first recess, for positioning the lamp ring in the base mounting machine, the second recess having an inner wall with at least one projection, the projection being set back via a side face of the inner wall from an outer circumferential section of the lamp ring, the lamp ring further having a second projection, the projections being arranged opposite one another and being spaced apart from one another via a bottom face, the first projection having a visible face, which lies in one plane with a visible face of the second projection, and the projections having opposite parallel opposing faces, the base mounting machine comprising a first and a second accommodating element for engaging in the first and the second recess of the lamp ring, the second accommodating element having a profiled top region, which is matched to the second recess.

6. A base mounting machine for producing a lamp, in particular for producing a low-volt halogen indicator lamp, with a lamp ring having a cutout for inserting a shell, and with fixing lugs for fixing the lamp ring to the shell, the lamp ring having a first recess on the circumferential side for coding the lamp, and a second recess, diametrically opposed to the first recess, for positioning the lamp ring in the base mounting machine, the second recess having an inner wall with at least one projection, the projection being set back via a side face of the inner wall from an outer circumferential section of the lamp ring, the lamp ring further having a second projection, the projections being arranged opposite one another and being spaced apart from one another via a bottom face, the first projection having a visible face, which lies in one plane with a visible face of the second projection and the projections having opposite parallel opposing faces, the side faces and the bottom face lying on an imaginary arc with a constant radius, the base mounting machine comprising a first and a second accommodating element for engaging in the first and the second recess of the lamp ring, the second accommodating element having a profiled top region, which is matched to the second recess.

* * * * *